US010437165B2

(12) United States Patent
Shimano et al.

(10) Patent No.: US 10,437,165 B2
(45) Date of Patent: Oct. 8, 2019

(54) TONER

(71) Applicant: CANON KABUSHIKI KAISHA, Tokyo (JP)

(72) Inventors: Tsutomu Shimano, Mishima (JP); Yoshihiro Nakagawa, Numazu (JP); Reo Tagawa, Susono (JP); Taku Shimoda, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/180,480

(22) Filed: Nov. 5, 2018

(65) Prior Publication Data

US 2019/0137901 A1 May 9, 2019

(30) Foreign Application Priority Data

Nov. 7, 2017 (JP) ..... 2017-214351

(51) Int. Cl.
*G03G 9/087* (2006.01)
*G03G 9/08* (2006.01)

(52) U.S. Cl.
CPC ..... *G03G 9/08782* (2013.01); *G03G 9/0821* (2013.01); *G03G 9/08711* (2013.01); *G03G 9/08755* (2013.01); *G03G 9/08795* (2013.01); *G03G 9/08797* (2013.01)

(58) Field of Classification Search
USPC ..... 430/108.4
See application file for complete search history.

(56) References Cited

U.S. PATENT DOCUMENTS

| | | | |
|---|---|---|---|
| 4,960,669 | A | 10/1990 | Mori et al. |
| 6,569,589 | B2 | 5/2003 | Inaba et al. |
| 7,582,402 | B2 | 9/2009 | Yamazaki et al. |
| 8,603,712 | B2 | 12/2013 | Aoki et al. |
| 8,741,519 | B2 | 6/2014 | Watanabe et al. |
| 8,778,585 | B2 * | 7/2014 | Matsui ..... G03G 9/0806 430/108.4 |
| 8,846,284 | B2 | 9/2014 | Kinumatsu et al. |
| 9,158,216 | B2 | 10/2015 | Shimano et al. |
| 9,170,509 | B2 | 10/2015 | Masuda |
| 9,377,705 | B2 | 6/2016 | Shimano et al. |
| 9,383,668 | B2 | 7/2016 | Noji et al. |
| 9,429,860 | B2 | 8/2016 | Kinumatsu et al. |
| 9,500,972 | B2 | 11/2016 | Tanaka et al. |
| 9,551,947 | B2 | 1/2017 | Hiroko et al. |
| 9,575,424 | B2 | 2/2017 | Nakagawa et al. |
| 9,599,919 | B2 | 3/2017 | Isono et al. |
| 9,658,549 | B2 | 5/2017 | Tanaka et al. |
| 9,785,071 | B2 | 10/2017 | Shimano et al. |
| 9,829,816 | B2 | 11/2017 | Tanaka et al. |
| 9,835,964 | B2 | 12/2017 | Yoshida et al. |
| 9,880,478 | B2 | 1/2018 | Shimano et al. |
| 9,904,193 | B2 | 2/2018 | Nakagawa et al. |
| 9,921,501 | B2 | 3/2018 | Mochizuki et al. |
| 9,952,523 | B2 | 4/2018 | Shimano et al. |
| 9,958,801 | B2 | 5/2018 | Tanaka et al. |
| 10,078,279 | B2 | 9/2018 | Nakagawa et al. |
| 10,101,681 | B2 | 10/2018 | Tagawa et al. |
| 10,114,303 | B2 | 10/2018 | Katsura et al. |

FOREIGN PATENT DOCUMENTS

| | | |
|---|---|---|
| JP | 2006-267516 | 10/2006 |
| JP | 2012-063574 | 3/2012 |
| JP | 6020458 | 10/2016 |
| JP | 2017-040772 | 2/2017 |
| JP | 2017-044952 | 3/2017 |

OTHER PUBLICATIONS

U.S. Appl. No. 15/969,318, Tsuneyoshi Tominaga, filed May 8, 2018.
U.S. Appl. No. 15/974,187, Sara Yoshida, filed May 9, 2018.
U.S. Appl. No. 15/975,305, Kentaro Yamawaki, filed May 2, 2018.
U.S. Appl. No. 16/180,386, Yoshihiro Nakagawa, filed Nov. 5, 2018.
Yuji Harazaki, Table 3.2 of "Basic Coating Science" (1977) 54-57.

* cited by examiner

*Primary Examiner* — Janis L Dote
(74) *Attorney, Agent, or Firm* — Venable LLP

(57) ABSTRACT

Provided is a toner having: a toner particle including a binder resin and a wax A, wherein the binder resin includes at least 50% by mass of a styrene acrylic copolymer in the binder resin, the melting point of the wax A is from 60.0° C. to 100.0° C., the wax A is compatible at 100° C. in an amount of at least 15.0 parts by mass with 100 parts by mass of a styrene-butyl acrylate copolymer, in DSC of the toner, where a peak temperature of a maximum exothermic peak derived from the wax A when cooling from 150° C. to 0° C. is performed at 1.0° C./min is denoted by Tc(1), and a peak temperature of a maximum exothermic peak derived from the wax A when cooling from 150° C. to 0° C. is performed at 20.0° C./min is denoted by Tc(20), 0.0° C.≤Tc(1)-Tc(20)≤7.0° C. is satisfied.

9 Claims, 3 Drawing Sheets

TONER

BACKGROUND OF THE INVENTION

Field of the Invention

The present invention relates to a toner used for forming a toner image by developing an electrostatic latent image formed by a method such as an electrophotographic method, an electrostatic recording method, or a toner jet recording method.

Description of the Related Art

In recent years, a demand has been created for further reduction in power consumption of printers and copying machines. To meet this demand, a toner that melts quickly at a lower temperature, that is, a toner excellent in low-temperature fixability is preferable. In order to obtain a toner excellent in low-temperature fixability, studies on using wax in a toner have been conducted.

The wax is added for the purpose of imparting plasticity to a binder resin. Since the wax melted and liquefied by heat becomes compatible with the binder resin, the viscosity of the toner at the time of melting is lowered, and a toner excellent in low-temperature fixability can be obtained.

Against such a background, Japanese Patent Application Publication No. 2017-040772, Japanese Patent Application Publication No. 2017-044952, Japanese Patent No. 6020458, Japanese Patent Application Publication No. 2012-63574 and Japanese Patent Application Publication No. 2006-267516 have suggested toners using ester waxes.

Meanwhile, it is also important that printers and copying machines could produce stable image quality over a long period of time. To meet this demand, a toner is needed which is excellent in mechanical strength and demonstrates little change in image quality over time when stored for a long period of time.

However, the wax added for the purpose of imparting plasticity to the binder resin has high compatibility with the binder resin. Therefore, part of the wax tends to remain compatible with the binder resin in the toner production process. As a result, there are cases where the mechanical strength of the toner is lowered, or the wax compatible with the binder resin is exposed to the surface of the toner with the lapse of time, thereby lowering the image quality.

Therefore, there is a demand for a toner using wax having high plasticity, the toner having low-temperature fixability and mechanical strength and excelling in temporal stability of image quality.

SUMMARY OF THE INVENTION

In the toners disclosed in Japanese Patent Application Publication No. 2017-040772 and Japanese Patent Application Publication No. 2017-044952, low-temperature fixability is improved by using an ester wax, but since compatibility between the ester wax and the binder resin is not sufficiently high, there is room for further improvement.

Further, in the toners disclosed in Japanese Patent No. 6020458, Japanese Patent Application Publication No. 2012-63574 and Japanese Patent Application Publication No. 2006-267516, an ester wax having high compatibility with the binder resin is used, but no investigation focusing on changes in image quality over time during long-term storage is disclosed. Therefore, there is a possibility that a part of the ester wax remains compatible with the binder resin in the process of producing the toner. As a result, there is room for further improvement of mechanical strength of the toner and temporal stability of image quality.

That is, the present invention provides a toner which has low-temperature fixability and mechanical strength and is excellent in temporal stability of image quality.

The present invention in its first aspect provides a toner having: a toner particle including a binder resin and a wax A, wherein the binder resin includes a styrene acrylic copolymer, the amount of the styrene acrylic copolymer in the binder resin is at least 50% by mass, a melting point of the wax A is from 60.0° C. to 100.0° C., the wax A is compatible at 100° C. in an amount of at least 15.0 parts by mass with 100 parts by mass of a styrene-butyl acrylate copolymer, which is a copolymer of 75 parts by mass of a styrene monomer and 25 parts by mass of a butyl acrylate monomer, and has a weight average molecular weight of 30,000, in differential scanning calorimetry of the toner, where a peak temperature of a maximum exothermic peak derived from the wax A when cooling from 150° C. to 0° C. is performed at 1.0° C./min is denoted by Tc(1), and a peak temperature of a maximum exothermic peak derived from the wax A when cooling from 150° C. to 0° C. is performed at 20.0° C./min is denoted by Tc(20), the Tc(1) and the Tc(20) satisfy a relationship of $0.0° C. \leq Tc(1)-Tc(20) \leq 7.0° C.$ The present invention in its second aspect provides a toner having: a toner particle including a binder resin, a wax A, and a crystalline material, wherein the binder resin includes a styrene acrylic copolymer, the amount of the styrene acrylic copolymer in the binder resin is at least 50% by mass, the ratio of the wax A to the total amount of the wax A and the crystalline material is at least 50% by mass, a melting point of the wax A is from 60.0° C. to 100.0° C., the wax A is an ester compound of a diol having 2 to 6 carbon atoms and an aliphatic monocarboxylic acid having 16 to 22 carbon atoms, a solubility parameter of the wax A is at least 8.81 $(cal/cm^3)^{1/2}$, in differential scanning calorimetry of the toner, where a peak temperature of a maximum exothermic peak when cooling from 150° C. to 0° C. is performed at 1.0° C./min is denoted by Tc(1), and a peak temperature of a maximum exothermic peak when cooling from 150° C. to 0° C. is performed at 20.0° C./min is denoted by Tc(20), the Tc(1) and the Tc(20) satisfy a relationship of $0.0° C. \leq Tc(1)-Tc(20) \leq 7.0° C.$ In accordance with the present invention, it is possible to provide a toner which has low-temperature fixability and mechanical strength and is excellent in temporal stability of image quality.

Further features of the present invention will become apparent from the following description of exemplary embodiments with reference to the attached drawings.

DESCRIPTION OF THE EMBODIMENTS

In the present invention, the expression "from AA to BB" and "AA to BB" representing a numerical range means a numerical range including a lower limit and an upper limit which are endpoints unless otherwise specified.

Further, the crystalline material is a compound for which an endothermic peak is observed in differential scanning calorimetry (DSC).

In order to obtain a toner which has low-temperature fixability and mechanical strength and excels in temporal stability of image quality, it is necessary to incorporate a wax having high compatibility with the binder resin in the toner in a phase-separated state.

With this in mind, the inventors of the present invention thought that phase separation with the binder resin would be caused by sufficiently increasing the degree of crystallinity of the wax and conducted extensive studies of this idea. The results obtained led to the creation of the present invention.

The degree of crystallinity means a ratio at which the wax added to the toner is crystallized.

Specifically, the degree of crystallinity is calculated from the endothermic amount when performing differential scanning calorimetry (hereinafter also referred to as DSC measurement) of the toner, the endothermic amount when performing DSC measurement of the wax, and the amount of wax charged.

The inventors of the present invention conducted the DSC measurement of a toner using a wax having high compatibility with a binder resin in the course of the study and found that the crystallization temperature remarkably decreased as the cooling rate was increased. Meanwhile, in the toner using the wax having low compatibility with the binder resin, almost no decrease in the crystallization temperature was confirmed.

Based on the results of this study, the inventors of the present invention considered the following.

In general, it is known that the crystallization process of wax consists of two processes: crystal nuclei generation and crystal growth.

Figure 1:
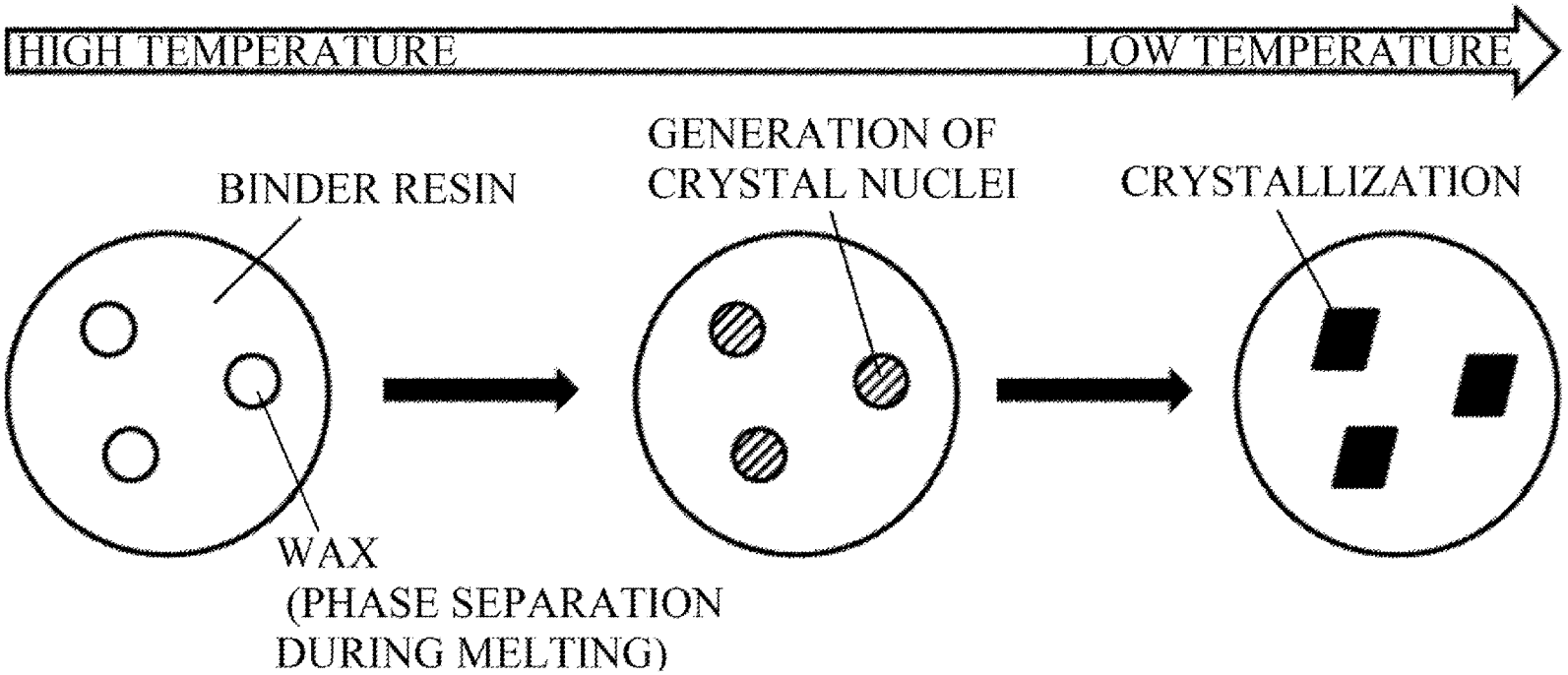
FIG. 1 is a schematic diagram showing a crystallization process of a wax having low compatibility with a binder resin.

In the case of using a wax having low compatibility with a binder resin, it is conceivable that part of the wax phase-separates from the binder resin at the time of melting. When cooled from such a state, the wax phase-separated at the time of melting crystallizes directly. Therefore, crystal nuclei are promptly generated at a substantially constant temperature regardless of the cooling rate (FIG. 1).

Figure 2:
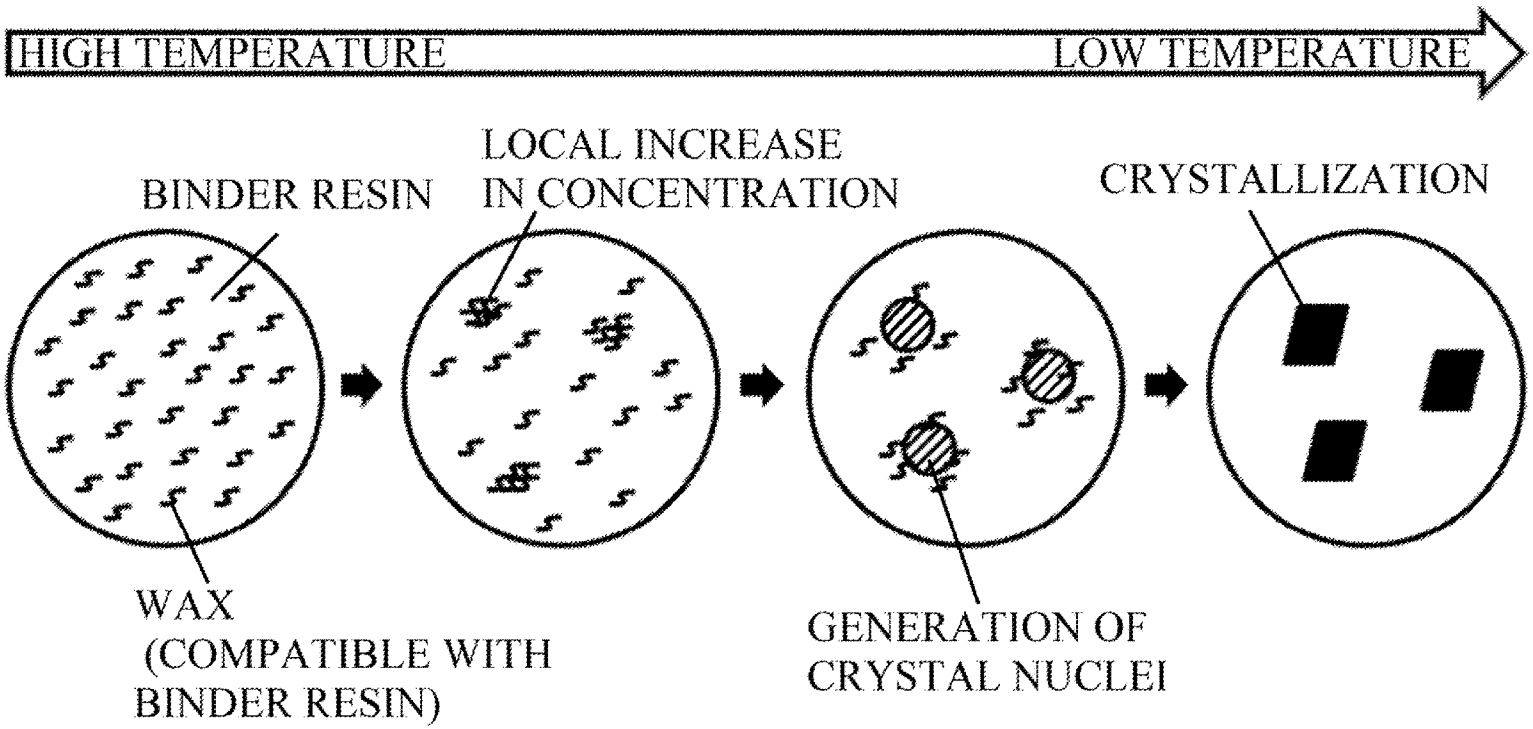
FIG. 2 is a schematic diagram showing a crystallization process of a wax having high compatibility with a binder resin.

Meanwhile, when a wax having high compatibility with a binder resin is used, it is thought that the entire wax is compatible with the binder resin at the time of melting. For the crystallization to proceed from such a state, it is conceivable that the wax compatible with the binder resin gathers first and the crystal nuclei are formed after local increase the concentration (FIG. 2).

Therefore, when the cooling rate is increased, it is conceivable that the process in which the wax gathers becomes a rate-determining process and the rate of generation of the crystal nuclei is reduced, resulting in a decrease in the crystallization temperature.

That is, when a wax having high compatibility with a binder resin is used, in particular, it is conceivable that the crystal nuclei generation rate is reduced, and it is considered that because of this, the crystallization of the wax does not proceed sufficiently and a component compatibilized with the binder resin remains.

Based on the above consideration, the inventors of the present invention have found that, in a toner using a wax highly compatible with a binder resin, the degree of crystallization of the wax in the toner is remarkably improved when the crystal nuclei generation rate is controlled and the toner is designed such that the crystallization temperature is unlikely to be lowered even when the cooling rate is increased.

The present invention has been accomplished through detailed analysis of toner against the problems that occur when a wax having high compatibility with a binder resin is used, and the present invention cannot be easily achieved on the basis of the related art.

The toner of present invention is a toner having: a toner particle including a binder resin and a wax A, wherein the binder resin includes a styrene acrylic copolymer, the amount of the styrene acrylic copolymer in the binder resin is at least 50% by mass, a melting point of the wax A is from 60.0° C. to 100.0° C., the wax A is compatible at 100° C. in an amount of at least 15.0 parts by mass with 100 parts by mass of a styrene-butyl acrylate copolymer, which is a copolymer of 75 parts by mass of a styrene monomer and 25 parts by mass of a butyl acrylate monomer, and has a weight average molecular weight of 30,000, in differential scanning calorimetry of the toner, where a peak temperature of a maximum exothermic peak derived from the wax A when cooling from 150° C. to 0° C. is performed at 1.0° C./min is denoted by Tc(1), and a peak temperature of a maximum exothermic peak derived from the wax A when cooling from 150° C. to 0° C. is performed at 20.0° C./min is denoted by Tc(20), the Tc(1) and the Tc(20) satisfy a relationship of $0.0° C. \leq Tc(1)-Tc(20) \leq 7.0° C.$ The toner uses the wax A showing high compatibility with a binder resin including a styrene acrylic copolymer.

That is, the wax A is compatible at 100° C. in an amount of at least 15.0 parts by mass with 100 parts by mass of the styrene-butyl acrylate copolymer. The styrene-butyl acrylate copolymer is a copolymer of 75 parts by mass of a styrene monomer and 25 parts by mass of a butyl acrylate monomer, and has a weight average molecular weight of 30,000.

The compatible amount at 100° C. is hereinafter also referred to as saturated compatible amount.

The saturated compatible amount is a numerical value indicating how much the wax A can be compatibilized with the styrene-butyl acrylate copolymer, and in the present invention, the saturated compatible amount is considered to indicate compatibility of the wax A with the binder resin including the styrene acrylic copolymer.

When the saturated compatible amount is at least 15.0 parts by mass, sufficient low-temperature fixability can be obtained. The upper limit of the saturated compatible amount is 100.0 parts by mass, and at this time, the styrene-butyl acrylate copolymer and wax A are arbitrarily mixed.

Even when the amount of the wax A contained in the toner particle is the same, the wax having a larger saturated compatible amount improves the low-temperature fixability more effectively.

The saturated compatible amount is preferably at least 25.0 parts by mass, and more preferably at least 45.0 parts by mass.

Meanwhile, when the saturated compatible amount is less than 15.0 parts by mass, as described above, crystal nuclei generation in the wax A in the binder resin occurs rapidly, so that the change of the toner over time, which is the problem to be solved by the present invention, is unlikely to occur, but the low-temperature fixability is insufficient.

The saturated compatible amount can be controlled by the solubility parameter (SP value) and molecular weight of the wax A. A method for measuring the saturated compatible amount will be described later.

Where the solubility parameters of the wax A and the styrene-butyl acrylate copolymer are denoted by SPw and SPc, respectively, and the weight average molecular weight of the wax A is denoted by Mw, the SPw, SPc, and Mw preferably satisfy a following formula (1), and more preferably satisfy a following formula (1)'. The unit of solubility parameter is $(cal/cm^3)^{1/2}$.

$$(SPc-SPw)^2 \times Mw \leq 680 \quad (1)$$

$$450 \leq (SPc-SPw)^2 \times Mw \leq 650 \quad (1)'$$

By using the wax A satisfying the formula (1), sufficient compatibility of the wax with the binder resin can be obtained. A method for calculating the SP value and a method for measuring the molecular weight will be described hereinbelow.

In the differential scanning calorimetry of the toner, where a peak temperature of a maximum exothermic peak derived from the wax A when cooling from 150° C. to 0° C. is performed at 1.0° C./min is denoted by Tc(1), and a peak temperature of a maximum exothermic peak derived from the wax A when cooling from 150° C. to 0° C. is performed at 20.0° C./min is denoted by Tc(20), the Tc(1) and the Tc(20) satisfy a relationship of 0.0° C.≤Tc(1)-Tc(20)≤7.0° C.

Tc(1)-Tc(20) is hereinafter also referred to as ΔTc.

The ΔTc being not more than 7.0° C. means that the nuclei generation rate in the wax A is sufficiently high. Therefore, it is possible to sufficiently reduce the amount of the wax A that has been compatibilized with the binder resin. As a result, even if the toner is allowed to stand in a high-temperature and high-humidity environment, exposure of the wax to the surface of the toner particles is suppressed, and the temporal stability of image quality is improved.

In addition, ΔTc is preferably from 0.0° C. to 6.5° C., and more preferably from 0.0° C. to 5.0° C.

The ΔTc can be controlled by the concentration of the wax A in the toner and the addition of a material for promoting crystal nuclei generation in the wax A. A method for measuring Tc(1) and Tc(20) will be described hereinbelow.

The melting point of the wax A is from 60.0° C. to 100.0° C.

By setting the melting point of the wax A at at least 60.0° C., it is possible to suppress the surface exposure of the wax even when the wax having a large saturated compatible amount is used. Further, by setting the melting point to not more than 100.0° C., sufficient low-temperature fixability can be obtained.

The melting point of the wax A is preferably from 65.0° C. to 90.0° C. The melting point of the wax A can be controlled by the constituent materials of the wax A. A method for measuring the melting point of the wax A will be described hereinbelow.

The amount of the wax A is preferably from 1 part by mass to 30 parts by mass with respect to 100 parts by mass of the binder resin.

For the peak temperature of the maximum exothermic peak in the differential scanning calorimetry of the toner to be the temperature derived from the wax A, the ratio of the wax A to the total amount of the wax A and crystalline materials other than the wax A is preferably at least 50% by mass.

When the ratio of the wax A to the total amount of the wax A and crystalline materials other than the wax A is at least 50% by mass, in the differential scanning calorimetry of the toner, the peak temperature Tc(1) of the maximum exothermic peak when cooling from 150° C. to 0° C. is performed at 1.0° C./min, and the peak temperature Tc(20) of the maximum exothermic peak when cooling from 150° C. to 0° C. is performed at 20.0° C./min are derived from the wax A.

It is preferable that the toner particle further include a crystalline material and in the differential scanning calorimetry of the crystalline material, where a peak temperature of a maximum exothermic peak when cooling from 150° C. to 0° C. is performed at 20.0° C./min is denoted by TcB (° C.), the Tc(20) and the TcB satisfy a relationship of Tc(20)≤TcB, and more preferably Tc(20)+15.0≤TcB.

Meeting this condition means that crystal nuclei of the crystalline material are sufficiently generated before the wax A crystallizes. As a result, the effect of promoting crystal nuclei generation in the wax A can be obtained, the ΔTc of the toner can be efficiently reduced, and a toner excellent in mechanical strength and temporal stability can be obtained. Further, in order to reduce the ΔTc of the toner without using the crystalline material, it is necessary to increase the amount of the wax A, so that coexistence with other toner performances may be difficult in some cases. A method for measuring the TcB will be described hereinbelow.

The crystalline material is not particularly limited, and known crystalline resins such as crystalline polyester resins and crystalline acrylic resins can be used in addition to known wax.

Further, it is preferable that the crystalline material be compatible at 100° C. in an amount of from 0.0 parts by mass to 5.0 parts by mass (incompatible or compatible at not more than 5.0 parts by mass) and more preferably in an amount of from 0.0 parts by mass to 2.0 parts by mass (incompatible or compatible at not more than 2.0 parts by mass) with 100 parts by mass of the styrene-butyl acrylate copolymer.

When the compatible amount is within the above range, it means that compatibility of the crystalline material with the binder resin is sufficiently low. Due to low compatibility, crystal nuclei of the crystalline material are likely to be generated, so that the ΔTc of the toner can be reduced more efficiently.

The amount of the crystalline material is preferably from 0.3 parts by mass to 6.0 parts by mass and more preferably from 1.0 part by mass to 3.0 parts by mass with respect to 100.0 parts by mass of the binder resin.

The crystalline material is preferably a hydrocarbon wax B. The effect of promoting crystal nuclei generation in the wax A is also influenced by the affinity of the crystalline material and the wax A. The hydrocarbon wax B is excellent in affinity with the wax A and the crystal nuclei generation rate in the hydrocarbon wax B itself is high, so that ΔTc of the toner can be decreased more efficiently.

Examples of the hydrocarbon wax B include petroleum waxes, hydrocarbon waxes and polyolefin waxes. In addition, these hydrocarbon waxes B exhibit similar effects even when a part thereof is modified with a substituent such as an alcohol, an amide, a urethane or the like, or one modified with a known resin such as a styrene acrylic resin.

In the differential scanning calorimetry of the toner, it is preferable that an endothermic amount ΔH of an endothermic peak when heating from 0° C. to 150° C. at 10° C./min be from 10.0 J/g to 35.0 J/g.

The endothermic amount ΔH means the amount of wax contained in the toner.

When this amount is at least 10.0 J/g, more excellent low-temperature fixability can be obtained.

Meanwhile, when this amount is not more than 35.0 J/g, more excellent mechanical strength can be obtained.

It is more preferable that the endothermic amount ΔH be from 20.0 J/g to 30.0 J/g. A method for measuring the endothermic amount ΔH will be described hereinbelow.

It is more preferable that the toner particles further include an amorphous polyester resin.

Generally, amorphous polyester resins have higher polarity than styrene acrylic resins and are, therefore, low in compatibility with nonpolar waxes. By including an amorphous polyester resin, it is possible to promote crystal nuclei generation in the wax A, so that it is possible to obtain a toner excellent in temporal stability.

The amount of the amorphous polyester resin is preferably from 1.0 part by mass to 10.0 parts by mass and more preferably from 2.0 parts by mass to 8.0 parts by mass with respect to 100.0 parts by mass of the binder resin.

As the amorphous polyester resin, a conventionally known polyester resin can be used.

As a specific example, an amorphous polyester resin is obtained by dehydration condensation of a dibasic acid or a derivative thereof (carboxylic acid halide, ester, acid anhydride) and a dihydric alcohol as essential components, and optionally a trivalent or higher polybasic acid and a derivative thereof (carboxylic acid halide, ester, acid anhydride), monobasic acid, trihydric or higher alcohol, monohydric alcohol, and the like.

Examples of the dibasic acid include aliphatic dibasic acids such as maleic acid, fumaric acid, itaconic acid, oxalic acid, malonic acid, succinic acid, dodecylsuccinic acid, dodecenylsuccinic acid, adipic acid, azelaic acid, sebacic acid, and decane-1,10-dicarboxylic acid; aromatic dibasic acids such as phthalic acid, tetrahydrophthalic acid, hexahydrophthalic acid, tetrabromophthalic acid, tetrachlorophthalic acid, HET acid, himic acid, isophthalic acid, terephthalic acid, and 2,6-naphthalenedicarboxylic acid.

Examples of derivatives of dibasic acids include carboxylic acid halides, esterification products and acid anhydrides of aliphatic dibasic acids and aromatic dibasic acids.

Meanwhile, examples of the dihydric alcohols include acyclic aliphatic diols such as ethylene glycol, 1,2-propanediol, 1,3-propanediol, 1,4-butanediol, 1,5-pentanediol, 1,6-hexanediol, diethylene glycol, dipropylene glycol, triethylene glycol, and neopentyl glycol; bisphenols such as bisphenol A and bisphenol F; alkylene oxide adducts of bisphenol A such as ethylene oxide adducts of bisphenol A and propylene oxide adducts of bisphenol A; and aralkylene glycols such as xylylene glycol.

Examples of trivalent or higher polybasic acids and anhydrides thereof include trimellitic acid, trimellitic anhydride, pyromellitic acid, and pyromellitic anhydride.

In the dynamic viscoelasticity measurement of the toner at 100° C., the ratio (G"/G', hereinafter also referred to as tan δ) of the loss elastic modulus G" to the storage elastic modulus G' is preferably not more than 1.50.

In the toner, the compatibility of the binder resin and the wax A is high, and the viscosity of the toner at the time of melting becomes extremely low. Therefore, when the fixing temperature is high, hot offset phenomenon in which a part of the image sticks to the fixing member is likely to occur.

When the value of tan δ is not more than 1.50, more excellent hot offset resistance can be obtained. Further, the lower the tan δ is, the higher the storage elastic modulus is than the loss elastic modulus. Therefore, when the value of tan δ is not more than 1.50, more excellent mechanical strength can be obtained. The value of tan δ is more preferably not more than 1.30. Meanwhile, the lower limit value of the tan δ value is not particularly limited, but is preferably about at least 0.70.

The tan δ can be controlled by the amount of a high-molecular-weight component or a crosslinking component contained in the toner and the amount of the wax A. A method for measuring the tan δ will be described hereinbelow.

The ratio (D4/D1) of the weight average particle diameter (D4) to the number average particle diameter (D1) of the toner is preferably from 1.00 to 1.25. Where (D4/D1) is not more than 1.25, better image quality can be obtained. (D4/D1) is more preferably not more than 1.20. The weight average particle diameter (D4) and the number average particle diameter (D1) of the toner can be controlled by the addition amount and melting point of the wax and the production conditions. Methods for measuring the weight average particle diameter (D4) and the number average particle diameter (D1) of the toner will be described hereinbelow.

The binder resin includes a styrene acrylic copolymer.

The amount of the styrene acrylic copolymer in the binder resin is at least 50% by mass, preferably from 80% by mass to 95% by mass.

The styrene acrylic copolymer is a copolymer of a styrene monomer and an acrylic monomer (acrylic acid or methacrylic acid and alkyl esters thereof).

Here, the styrene acrylic copolymer may be contained in the binder resin in a state of being constituted only by the styrene acrylic copolymer, or may be contained in the binder resin as a block copolymer or a graft copolymer with another polymer or a mixture thereof.

When the amount of the styrene acrylic copolymer in the binder resin is at least 50% by mass, the value of the saturated compatible amount is usable.

Further, in addition to the styrene acrylic copolymer, a known resin or polymer, which can be used for a toner, can be used for the binder resin.

For example, a polyester resin, a polyamide resin, a furan resin, an epoxy resin, a xylene resin, and a silicone resin can be used.

Examples of the styrene monomer are presented below.

Styrene, α-methyl styrene, β-methylstyrene, o-methylstyrene, m-methylstyrene, p-methylstyrene, 2,4-dimethylstyrene, divinylbenzene and the like.

The styrene monomer may be used singly or in combination of two or more selected from these styrene monomers.

Examples of the acrylic monomer are presented below.

Acrylic acid alkyl esters such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, n-decyl acrylate, and n-dodecyl acrylate;

methacrylic acid alkyl esters such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, n-decyl methacrylate, and n-dodecyl methacrylate;

acrylic acid diesters such as diethylene glycol diacrylate, triethylene glycol diacrylate, tetraethylene glycol diacrylate, polyethylene glycol diacrylate, and 1,6-hexanediol diacrylate; and acrylic acid, methacrylic acid and the like.

The acrylic monomer may be used singly or in combination of two or more selected from these acrylic monomers.

It is preferable that the styrene acrylic copolymer include at least one copolymer selected from the group consisting of a styrene-alkyl acrylate copolymer and a styrene-alkyl methacrylate copolymer; and the alkyl group of the alkyl acrylate and the alkyl group of the alkyl methacrylate each have 2 to 10 carbon atoms, more preferably 2 to 8 carbon atoms, and even more preferably 2 to 6 carbon atoms.

When the number of carbon atoms in the alkyl group is within the above range, the toner design based on the value of the saturated compatible amount of the wax A can be suitably applied. The toner design based on the value of the saturated compatible amount is possible even when the styrene acrylic copolymer is not the styrene-butyl acrylate copolymer itself.

The polymerization ratio of the styrene monomer and the acrylic monomer (styrene monomer:acrylic monomer) is preferably 50:50 to 99:1 and more preferably 65:35 to 80:20.

The wax A is not particularly limited as long as it has the above characteristics, and a known wax can be used.

From the viewpoint of compatibility with the styrene acrylic copolymer contained in the binder resin, the wax A can be suitably exemplified by an ester wax which is a condensate of an alcohol component and a carboxylic acid component.

Specifically, it is preferable that the wax A include an ester compound of a diol and an aliphatic monocarboxylic acid.

Further, the wax A is preferably an ester compound of a diol having 2 to 6 carbon atoms and an aliphatic monocarboxylic acid having 16 to 22 carbon atoms.

The solubility parameter (SP value) of the wax A is preferably at least 8.81 $(cal/cm^3)^{1/2}$, and more preferably at least 8.83 $(cal/cm^3)^{1/2}$. The upper limit value of the SP value is not particularly limited, but is preferably not more than 9.00 $(cal/cm^3)^{1/2}$.

Examples of diols having 2 to 6 carbon atoms include ethylene glycol, diethylene glycol, 1,3-propanediol, 1,4-butanediol, and 1,6-hexanediol.

Examples of aliphatic monocarboxylic acids having 16 to 22 carbon atoms include aliphatic monocarboxylic acids such as palmitic acid, stearic acid, and behenic acid.

The amount of the wax A is preferably from 1 part by mass to 30 parts by mass, and more preferably from 10 parts by mass to 30 parts by mass with respect to 100 parts by mass of the binder resin.

The toner particle may include a colorant. The colorant can be exemplified by various conventionally known dyes and pigments.

Examples of black colorants include carbon black and the like.

Examples of yellow colorants include yellow pigments represented by monoazo compounds, disazo compounds, condensed azo compounds, isoindolinone compounds, isoindoline compounds, benzimidazolone compounds, anthraquinone compounds, azo metal complexes, methine compounds, and allylamide compounds.

Specific examples include C. I. Pigment Yellow 74, 93, 95, 109, 111, 128, 155, 174, 180, and 185.

Examples of the magenta colorants include monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples include C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, 269, and C. I. Pigment Violet 19.

Examples of the cyan colorants include cyan pigments represented by copper phthalocyanine compounds and derivatives thereof, anthraquinone compounds, and basic dye lake compounds.

Specific examples include C. I. Pigment Blue 1, 7, 15, 15:1, 15:2, 15:3, 15:4, 60, 62, and 66.

Various dyes conventionally known as colorants can be used together with the pigments.

The amount of the colorant is preferably from 1.0 part by mass to 20.0 parts by mass with respect to 100 parts by mass of the binder resin.

If necessary, the toner particle may include known materials such as a charge control agent, a charge control resin, and a pigment dispersant.

A toner may also be obtained by optionally mixing the toner particle with an external additive and causing the external additive to adhere to the surface thereof.

Examples of the external additive include inorganic fine particles selected from silica fine particles, alumina fine particles, and titania fine particles, or composite oxides thereof.

Examples of the composite oxide include silica aluminum fine particles and strontium titanate fine particles.

The addition amount of the external additive is preferably from 0.01 parts by mass to 8.0 parts by mass, more preferably from 0.1 parts by mass to 4.0 parts by mass with respect to 100 parts by mass of the toner particle.

The toner particle can be produced by a known production method such as a pulverization method, a suspension polymerization method, an emulsion aggregation method, a dissolution suspension method, and the production method thereof is not particularly limited.

A method for producing the toner is not particularly limited, and may include either one of the following steps (i) and (ii) in the production process of the toner particle.

(i) A step of forming a particle of a polymerizable monomer composition including the wax A and a polymerizable monomer capable of forming a binder resin including a styrene acrylic copolymer in an aqueous medium, and polymerizing the polymerizable monomer contained in the particle of the polymerizable monomer composition (suspension polymerization method).

(ii) A step of forming a particle of a resin solution obtained by dissolving or dispersing the wax A and the binder resin including a styrene acrylic copolymer in an organic solvent in an aqueous medium, and removing the organic solvent contained in the particle of the resin solution (dissolution suspension method).

Hereinafter, methods for measuring physical properties of the toner and constituent materials will be described.

<Method for Measuring Saturated Compatible Amount>

The saturated compatible amount of the wax relative to the styrene-butyl acrylate copolymer at 100° C. is measured in the following manner.

The styrene-butyl acrylate copolymer is a copolymer of 75 parts by mass of a styrene monomer and 25 parts by mass of a butyl acrylate monomer, and has a weight average molecular weight of 30,000.

A total of 1.00 g of the styrene-butyl acrylate copolymer is weighed in a 30 mL vial bottle and heated to 100° C. Thereafter, the wax is added to the vial bottle, thoroughly mixed at 100° C. and visually observed.

Where the mixture is found by visual observations to be transparent, the compatibility is determined to be possible.

The wax is added by 0.005 g (0.5 parts by mass with respect to the styrene-butyl acrylate copolymer) to obtain the maximum amount at which compatibility is determined.

<Method for Calculating Solubility Parameter (SP Value)>

The solubility parameter (SP value) is obtained using Fedors' equation (2).

For values of Δei and Δvi given below, see "evaporation energy and molar volume (25° C.) of atoms and atomic groups described in Basic Coating Science, pp. 54-57, 1986 (Maki Shoten) Tables 3-9".

The unit of the SP value is $(cal/cm^3)^{1/2}$, but it can be converted into $(J/m^3)^{1/2}$ since 1 $(cal/cm^3)^{1/2}=2.046\times10^3$ $(J/m^3)^{1/2}$.

$$\delta i=(Ev/V)^{1/2}=(\Delta ei/\Delta vi)^{1/2} \quad (2)$$

Ev: evaporation energy

V: molar volume

Δei: evaporation energy of atom or atomic group of component i

Δvi: molar volume of atom or atomic group of component i

<Method for Measuring Weight Average Molecular Weight (Mw) of Wax>

The weight average molecular weight (Mw) of the wax is measured in the following manner by gel permeation chromatography (GPC).

First, at room temperature, the wax is dissolved in tetrahydrofuran (THF). Where the wax is difficult to dissolve, the wax is heated in the range of not more than 35° C. Then, the obtained solution is filtered through a solvent-resistant membrane filter "Mysyori Disk" (manufactured by Tosoh Corporation) having a pore diameter of 0.2 μm to obtain a sample solution. The sample solution is adjusted so that the concentration of the component soluble in THF is 0.8% by mass. This sample solution is used to perform measurements under the following conditions.

Apparatus: High-speed GPC apparatus "HLC-8220 GPC" [manufactured by Tosoh Corporation]

Column: 2 sets of LF-604 [manufactured by Showa Denko KK]

Eluent: THF

Flow rate: 0.6 mL/min

Oven temperature: 40° C.

Sample injection amount: 0.020 mL

To calculate the molecular weight of the sample, a molecular weight calibration curve prepared using standard polystyrene resins (trade name "TSK Standard Polystyrene F-850, F-450, F-288, F-128, F-80, F-40, F-20, F-10, F-4, F-2, F-1, A-5000, A-2500, A-1000, A-500" manufactured by Tosoh Corporation) is used.

<Method for Measuring Tc(1) and Tc(20) of Toner>

Tc(1) and Tc(20) of the toner are measured using a differential scanning calorimeter "Q1000" (manufactured by TA Instruments).

The melting points of indium and zinc are used for temperature correction of the apparatus detection unit, and the heat of fusion of indium is used for correction of the calorific value.

Specifically, 3 mg of the toner is accurately weighed and placed in an aluminum pan. An empty aluminum pan is used as a reference, and the temperature is raised from 0° C. to 150° C. at a ramp rate of 10° C./min and maintained at 150° C. for 5 min.

Thereafter, cooling is performed from 150° C. to 0° C. at a cooling rate of 1.0° C./min. The peak temperature of the maximum exothermic peak derived from the wax A in the DSC curve at this time is taken as Tc(1).

Meanwhile, the peak temperature of the maximum exothermic peak derived from the wax A in the DSC curve when the cooling rate for cooling from 150° C. to 0° C. is changed to 20.0° C./min is taken as Tc(20).

<Method for Measuring Melting Point and Crystallization Temperature (TcB) of Wax and Crystalline Material>

The melting point and the crystallization temperature (TcB) of the wax and the crystalline material are measured using a differential scanning calorimeter "Q1000" (manufactured by TA Instruments).

The melting points of indium and zinc are used for temperature correction of the apparatus detection unit, and the heat of fusion of indium is used for correction of the calorific value.

Specifically, 1 mg of wax or crystalline material is accurately weighed and placed in an aluminum pan. An empty aluminum pan is used as a reference, and the temperature is raised from 0° C. to 150° C. at a ramp rate of 10° C./min and maintained at 150° C. for 5 min.

Thereafter, cooling is performed from 150° C. to 0° C. at a cooling rate of 20.0° C./min. The peak temperature of the maximum exothermic peak in the DSC curve at this time is taken as the crystallization temperature of the wax or crystalline material.

Subsequently, after maintaining at 0° C. for 5 min, the temperature is raised from 0° C. to 150° C. at a ramp rate of 10° C./min. The peak temperature of the maximum endothermic peak in the DSC curve at this time is taken as the melting point of the wax or crystalline material. The crystallization temperature of the crystalline material is TcB.

<Method for Measuring Endothermic Amount ΔH of Toner>

The endothermic amount ΔH of the toner is measured using a differential scanning calorimeter "Q1000" (manufactured by TA Instruments).

The melting points of indium and zinc are used for temperature correction of the apparatus detection unit, and the heat of fusion of indium is used for correction of the calorific value.

Specifically, 3 mg of the toner is accurately weighed and placed in an aluminum pan. An empty aluminum pan is used as a reference, and the temperature is raised from 0° C. to 150° C. at a ramp rate of 10° C./min. The endothermic amount of the endothermic peak in the DSC curve at this time is taken as the endothermic amount ΔH of the toner. When a plurality of endothermic peaks is observed in the DSC curve (for example, endothermic peaks of the wax A and crystalline material are observed), the endothermic amount obtained by totaling the endothermic amounts of the respective endothermic peaks is taken as the endothermic amount ΔH of the toner.

<Method for Measuring tan δ of Toner at 100° C.>

As a measuring device, a rotating plate type rheometer "ARES" (manufactured by TA Instruments) is used.

A sample pressed into a disk shape having a diameter of 7.9 mm and a thickness of 2.0±0.3 mm by using a tablet former is used as a measurement sample under a 25° C. environment.

The sample is mounted on a parallel plate having a diameter of 8.0 mm, the temperature is raised from room temperature (25° C.) to 100° C. over 15 min, the shape of the sample is adjusted, and after holding for 10 minutes, the measurement is started.

The measurement is carried out under conditions of a temperature of 100° C., a frequency of 1.0 Hz, and a strain of 1.0%.

The ratio (G"/G') of the loss elastic modulus G" to the storage elastic modulus G' obtained by the measurement is tan δ.

<Method for Measuring Particle Size Distribution of Toner>

The particle size distribution of the toner is calculated as follows.

A precision particle size distribution measuring apparatus "Coulter Counter Multisizer 3" (registered trademark, manufactured by Beckman Coulter, Inc.) which is based on a pore electric resistance method and equipped with a 100 μm aperture tube is used as a measuring apparatus.

Dedicated software "Beckman Coulter Multisizer 3 Version 3.51" (manufactured by Beckman Coulter, Inc.) supplied with the apparatus is used to set measurement conditions and analyze measurement data. Measurement is performed with the number of effective measurement channels of 25,000 channels.

A solution prepared by dissolving special grade sodium chloride in ion exchanged water to a concentration of about 1% by mass, for example, "ISOTON II" (manufactured by Beckman Coulter, Inc.), can be used as the electrolytic aqueous solution to be used for measurement.

The dedicated software is set up in the following manner before the measurement and analysis.

The total count number in a control mode is set to 50,000 particles on a "CHANGE STANDARD OBSERVATION METHOD (SOM)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the "MEASUREMENT BUTTON OF THE THRESHOLD/NOISE LEVEL". Further, the current is set to 1600 μA, the gain is set to 2, the electrolytic solution is set to ISOTON II, and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "FLUSH OF APERTURE" function of the dedicated software.

(2) 30 ml of the electrolytic aqueous solution is placed in a glass 100 mL flat-bottom beaker. Then, 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. A total of 3.3 L of ion exchanged water is placed in the water tank of the ultrasonic disperser, and 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) The toner is added little by little to the electrolytic aqueous solution and dispersed therein in a state in which the electrolytic aqueous solution in the beaker of (4) hereinabove is irradiated with ultrasonic waves so as to obtain 10 mg of the toner. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be 5%. Then, measurement is conducted until the number of particles to be measured reaches 50,000.

(7) The measurement data are analyzed with the dedicated software provided with the device, and the weight average particle diameter (D4) and number average particle diameter (D1) are calculated.

EXAMPLES

Hereinafter, the present invention will be specifically described with reference to examples, but the present invention is not limited to these examples. In the examples, parts and percentages are on a mass basis unless otherwise specified.

Production Example of Amorphous Polyester Resin 1

A total of 1.0 mol of terephthalic acid, 0.65 mol of propylene oxide 2 mol adduct of bisphenol A, and 0.35 mol of ethylene glycol were added to a reaction vessel equipped with a stirrer, a thermometer, a nitrogen introducing tube, a dehydration tube, and a pressure reducing device, followed by heating to a temperature of 130° C. under stirring.

Thereafter, 0.52 parts of di(2-ethylhexanoic acid) tin as an esterification catalyst was added to a total of 100.0 parts of the monomers, the temperature was then raised to 200° C., and polycondensation was conducted till the desired molecular weight was obtained.

Further, 0.03 mol of trimellitic anhydride was added to obtain an amorphous polyester resin 1.

The amorphous polyester resin 1 thus obtained had a weight average molecular weight (Mw) of 6000, a glass transition temperature (Tg) of 49° C., and an acid value of 11.2 mg KOH/g.

Production Example of Crystalline Material B4 (Crystalline Polyester)

A total of 1.0 mol of sebacic acid and 1.0 mol of 1,12-dodecanediol were added to a reaction vessel equipped with a stirrer, a thermometer, a nitrogen introducing tube, a dehydration tube, and a pressure reducing device, followed by heating to a temperature of 130° C. under stirring.

Thereafter, 0.7 part of titanium (IV) isopropoxide as an esterification catalyst was added to 100.0 parts of the total amount of the above monomers, the temperature was raised to 180° C., and the reaction was allowed to proceed until the desired molecular weight was reached while reducing pressure, whereby a crystalline polyester resin (crystalline material B4) was obtained.

The resulting crystalline material B4 had a weight average molecular weight (Mw) of 20,000, a melting point (Tm) of 82.1° C. and a crystallization temperature (TcB) of 68.0° C.

Tables 1 and 2 show the names and physical properties of the wax A and the crystalline material used in Examples and Comparative Examples.

TABLE 1

| Type of wax A | Composition | Saturated compatible amount (parts) | Melting point Tm (° C.) | SPw | Mw | $(SPc - SPw)^2 \times Mw$ |
|---|---|---|---|---|---|---|
| A1 | Ethylene glycol distearate | 45.0 | 75.8 | 8.85 | 595 | 537 |
| A2 | Ethylene glycol dipalmitate | 100.0 | 69.1 | 8.88 | 539 | 456 |
| A3 | Hexanediol distearate | 25.0 | 63.2 | 8.83 | 651 | 613 |
| A4 | Condensate of Butanediol and stearic acid/behenic acid (stearic acid and behenic acid are at a molar ratio of 1:1) | 18.0 | 72.0 | 8.82 | 679 | 652 |
| A5 | Butanediol dibehenate | 10.0 | 76.7 | 8.80 | 735 | 735 |
| A6 | Dibehenyl sebacate | 6.5 | 73.1 | 8.77 | 819 | 869 |
| A7 | Behenyl behenate | 5.0 | 69.8 | 8.59 | 649 | 785 |

In the table,

SPw and SPc represent solubility parameters (SP values) of the wax A and the styrene-butyl acrylate copolymer, and Mw represents the weight average molecular weight of the wax A.

The unit of solubility parameter (SP value) is $(cal/cm^3)^{1/2}$.

TABLE 2

| Type of crystalline material | Composition | Saturated compatible amount (parts) | Crystallization temperature TcB (° C.) |
|---|---|---|---|
| B1 | Hydrocarbon wax (HNP-9, manufactured by Nippon Seiro Co., Ltd.) | 2.0 | 75.1 |
| B2 | Hydrocarbon wax (FNP-0090, manufactured by Nippon Seiro Co., Ltd.) | 0.5 | 89.5 |
| B3 | Hydrocarbon wax (HNP-3, manufactured by Nippon Seiro Co., Ltd.) | 5.0 | 61.8 |
| B4 | Crystalline polyester | 3.0 | 68.0 |
| B5 | Dipentaeryhtritol tetrastearate | 1.5 | 62.5 |
| B6 | Glycerin tribehenate | 3.0 | 63.1 |

Production examples of the toner are shown below. Toners 1 to 17 were produced as examples and toners 18 to 26 were produced as comparative examples.

Production Example of Toner 1

| | |
|---|---|
| Styrene | 60.0 parts |
| Colorant | 6.0 parts |

(C.I. Pigment Blue 15:3, manufactured by Dainichiseika Color & Chemicals Mfg. Co., Ltd.)

The above materials were charged into an attritor (manufactured by Mitsui Miike Machinery Co., Ltd.) and further dispersed for 5 h at 220 rpm using zirconia particles having a diameter of 1.7 mm to obtain a pigment-dispersed solution.

| | |
|---|---|
| Styrene | 15.0 parts |
| n-Butyl acrylate | 25.0 parts |
| Amorphous polyester resin 1 | 5.0 parts |
| Wax A1 | 15.0 parts |
| Crystalline material B1 | 3.0 parts |
| Divinylbenzene | 0.7 parts |

The above materials were mixed and added to the pigment-dispersed solution. The resulting mixture was kept at 60° C., and a polymerizable monomer composition was prepared by stirring at 500 rpm and uniformly dissolving and dispersing by using a T. K. Homomixer (manufactured by Tokushu Kika Kogyo Co., Ltd.).

Meanwhile, 850.0 parts of a 0.10 mol/L $Na_3PO_4$ aqueous solution and 8.0 parts of 10% hydrochloric acid were added to a vessel equipped with a high-speed stirrer CLEARMIX (manufactured by M Technique Co., Ltd.), the rotational speed was adjusted to 15,000 rpm, and heating was performed to 70° C.

Then, 68.0 parts of 1.0 mol/L $CaCl_2$ aqueous solution was added to prepare an aqueous medium including a calcium phosphate compound.

After charging the polymerizable monomer composition into the aqueous medium, 9.0 parts of t-butyl peroxypivalate as a polymerization initiator was added, and granulation was performed for 10 min while maintaining the rotation speed of 15,000 rpm. Thereafter, the stirrer was changed from the high-speed stirrer to a propeller stirring blade, the reaction was carried out at 70° C. for 5 h while refluxing, then the liquid temperature was set to 85° C., and the reaction was further carried out for 2 h.

After completion of the polymerization reaction, the obtained slurry was cooled, a part thereof was taken out, and the particle size distribution was measured.

Further, hydrochloric acid was added to the slurry to adjust the pH to 1.4, and the calcium phosphate salt was dissolved by stirring for 1 h. Thereafter, the slurry was washed with a three-fold amount of water, filtered, dried, and then classified to obtain toner particles.

Thereafter, 100.0 parts of the toner particles were treated with dimethylsilicone oil (20% by mass) as an external additive, 2.0 parts of silica fine particles (number average particle diameter of primary particle: 10 nm, BET specific surface area: 170 $m^2/g$) which were triboelectrically charged to the same polarity (negative polarity) as that of the toner particles and subjected to a hydrophobic treatment were added, and mixing was performed at 3000 rpm for 15 min using a Mitsui Henschel mixer (manufactured by Mitsui Miike Chemical Engineering Co., Ltd.) to obtain a toner 1.

Production Examples of Toners 2 to 16 and 18 to 25

Toners 2 to 16 and 18 to 25 were obtained in the same manner as in the production example of toner 1 except that the type and amount added of the wax A, the type and amount added of the crystalline material, and the type and amount added of the polymerizable monomer were changed as shown in Table 3.

However, in the production of toner 12, 1.0 part of an aluminum salicylate compound (Bontron E-88, manufactured by Orient Chemical Industries, Ltd.) was added without adding the amorphous polyester resin 1.

TABLE 3

| | Wax A | | Crystalline material | | Polymerizable monomer | |
|---|---|---|---|---|---|---|
| Toner No. | Type | Amount (parts) | Type | Amount (parts) | Type | Amount (parts) |
| 1 | A1 | 15.0 | B1 | 3.0 | Styrene:n-BA:DVB | 75.0:25.0:0.7 |
| 2 | A2 | 15.0 | B1 | 3.0 | Styrene:n-BA:DVB | 75.0:25.0:0.7 |
| 3 | A3 | 15.0 | B1 | 3.0 | Styrene:n-BA:DVB | 75.0:25.0:0.7 |
| 4 | A4 | 15.0 | B1 | 3.0 | Styrene:n-BA:DVB | 75.0:25.0:0.7 |
| 5 | A1 | 15.0 | B1 | 0.3 | Styrene:n-BA:DVB | 75.0:25.0:0.7 |
| 6 | A1 | 15.0 | B2 | 3.0 | Styrene:n-BA:DVB | 75.0:25.0:0.7 |
| 7 | A1 | 15.0 | B3 | 3.0 | Styrene:n-BA:DVB | 75.0:25.0:0.7 |

TABLE 3-continued

| | Wax A | | Crystalline material | | Polymerizable monomer | |
|---|---|---|---|---|---|---|
| Toner No. | Type | Amount (parts) | Type | Amount (parts) | Type | Amount (parts) |
| 8 | A1 | 15.0 | B4 | 3.0 | Styrene:n-BA:DVB | 75.0:25.0:0.7 |
| 9 | A1 | 10.0 | B1 | 3.0 | Styrene:n-BA:DVB | 75.0:25.0:0.7 |
| 10 | A1 | 20.0 | B1 | 3.0 | Styrene:n-BA:DVB | 75.0:25.0:0.7 |
| 11 | A1 | 30.0 | — | — | Styrene:n-BA:DVB | 75.0:25.0:0.7 |
| 12 | A1 | 15.0 | B1 | 3.0 | Styrene:n-BA:DVB | 75.0:25.0:0.7 |
| 13 | A1 | 15.0 | B1 | 3.0 | Styrene:n-BA:DVB | 75.0:25.0:0.3 |
| 14 | A1 | 15.0 | B1 | 3.0 | Styrene:n-BA:DVB | 75.0:25.0:0.4 |
| 15 | A1 | 15.0 | B1 | 3.0 | Styrene:EA:DVB | 65.0:35.0:0.7 |
| 16 | A1 | 15.0 | B1 | 3.0 | Styrene:OA:DVB | 78.0:22.0:0.7 |
| 17 | A1 | 15.0 | B1 | 3.0 | Dissolution suspension method | |
| 18 | A1 | 15.0 | — | — | Styrene:n-BA:DVB | 75.0:25.0:0.7 |
| 19 | A1 | 10.0 | — | — | Styrene:n-BA:DVB | 75.0:25.0:0.7 |
| 20 | A1 | 10.0 | B5 | 5.0 | Styrene:n-BA:DVB | 75.0:25.0:0.7 |
| 21 | A1 | 10.0 | B6 | 5.0 | Styrene:n-BA:DVB | 75.0:25.0:0.7 |
| 22 | A5 | 15.0 | B1 | 3.0 | Styrene:n-BA:DVB | 75.0:25.0:0.7 |
| 23 | A6 | 15.0 | B1 | 3.0 | Styrene:n-BA:DVB | 75.0:25.0:0.7 |
| 24 | A7 | 15.0 | B1 | 3.0 | Styrene:n-BA:DVB | 75.0:25.0:0.7 |
| 25 | A7 | 15.0 | — | — | Styrene:n-BA:DVB | 75.0:25.0:0.7 |
| 26 | A1 | 15.0 | — | — | Dissolution suspension method | |

In the table, n-BA represents n-butyl acrylate, EA represents ethyl acrylate, OA represents octyl acrylate, and DVB represents divinylbenzene.

Production Example of Toner 17 (Dissolution Suspension Method)

Preparation of Master Batch

A total of 40 parts of C. I. Pigment Blue 15:3 (manufactured by Dainichiseika Color & Chemicals Mfg. Co., Ltd.), 60 parts of a styrene-butyl acrylate copolymer (styrene: butyl acrylate (mass ratio)=75:25, glass transition temperature (Tg)=52° C., weight average molecular weight (Mw)=70,000, number average molecular weight (Mn)=12,000, peak molecular weight (Mp)=35,000) and 30 parts of water were mixed in a HENSCHEL MIXER to obtain a mixture in which water was impregnated in a pigment aggregate. The mixture was kneaded for 60 min by a two-roll mill in which the surface temperature of the roll was set at 130° C., and then pulverized to obtain a master batch.

(Preparation of Pigment/Wax-Dispersed Solution)

A total of 970 parts of the styrene-butyl acrylate copolymer, 190.5 parts of the wax A1, 38.1 parts of the crystalline material B1, and 1450 parts of an ethyl acetate/methyl ethyl ketone mixed solution (60/40[% by volume]) were charged in a vessel equipped with a stirring rod and a thermometer, the temperature was raised to 80° C. under stirring, and the temperature was kept at 80° C. for 5 h.

Subsequently, 500 parts of the master batch and 330 parts of an ethyl acetate/methyl ethyl ketone mixed solution (60/40[% by volume]) were charged into the vessel and mixed for 1 h to obtain a raw material solution.

A total of 1500 parts of the raw material solution was charged into an attritor (manufactured by Mitsui Miike Machinery Co., Ltd.) and further dispersed for 5 h at 220 rpm by using zirconia particles having a diameter of 1.7 mm to obtain a pigment/wax-dispersed solution.

The mixture was adjusted by adding the ethyl acetate/methyl ethyl ketone mixed solution (60/40[% by volume]) so that the solid fraction concentration of the pigment/wax-dispersed solution was 50%. Further, the raw material solution was heated to 60° C.

(Preparation of Aqueous Phase)

A total of 850.0 parts of a 0.10 mol/L $Na_3PO_4$ aqueous solution and 8.0 parts of 10% hydrochloric acid were added to a vessel equipped with a high-speed stirrer CLEARMIX (manufactured by M Technique Co., Ltd.), the rotational speed was adjusted to 15,000 rpm, and heating was performed to 60° C. Then, 68.0 parts of 1.0 mol/L $CaCl_2$ aqueous solution was added to prepare an aqueous phase including a calcium phosphate compound.

(Granulation/Solvent Removal)

A total of 200.0 parts of the pigment/wax-dispersed solution was loaded in the aqueous phase and granulation was directly performed for 10 min while maintaining the temperature of 60° C. and the rotation speed of 15,000 rpm in the high-speed stirrer. Thereafter, the stirrer was changed from the high-speed stirrer to a stirrer equipped with a propeller stirring blade, and solvent removal was carried out at 80° C. for 5 h to obtain a slurry.

(Washing/Drying/External Addition)

After completion of solvent removal, the obtained slurry was cooled, a part thereof was taken out, and the particle size distribution was measured.

Further, hydrochloric acid was added to the slurry to adjust the pH to 1.4, and the calcium phosphate salt was dissolved by stirring for 1 h. Thereafter, the slurry was washed with a three-fold amount of water, filtered, dried, and then classified to obtain toner particles.

Thereafter, 100.0 parts of the toner particles were treated with dimethylsilicone oil (20% by mass) as an external additive, 2.0 parts of silica fine particles (number average particle diameter of primary particle: 10 nm, BET specific surface area: 170 $m^2/g$) which were triboelectrically charged to the same polarity (negative polarity) as that of the toner particles and subjected to a hydrophobic treatment were added, and mixing was performed at 3000 rpm for 15 min by using a MITSUI HENSCHEL MIXER (manufactured by Mitsui Miike Chemical Engineering Co., Ltd.) to obtain a toner 17.

Production Example of Toner 26 (Dissolution Suspension Method)

A toner 26 was obtained in the same manner as in the production example of toner 17 except that the crystalline material B1 was not added in the production example of toner 17.

With respect to the toners 1 to 26 obtained, the physical properties were measured using the above-mentioned method. The results are summarized in Table 4.

TABLE 4

| | Toner No. | Tc (1) (° C.) | Tc (20) (° C.) | ΔTc (° C.) | ΔH (J/g) | tanδ | D4 (μm) | D4/D1 |
|---|---|---|---|---|---|---|---|---|
| Example 1 | 1 | 59.3 | 55.5 | 3.8 | 25.2 | 1.00 | 6.4 | 1.17 |
| Example 2 | 2 | 50.9 | 47.9 | 3.0 | 25.1 | 1.00 | 6.4 | 1.17 |
| Example 3 | 3 | 56.3 | 54.2 | 2.1 | 23.0 | 1.00 | 6.4 | 1.17 |
| Example 4 | 4 | 59.5 | 57.5 | 2.0 | 23.3 | 1.00 | 6.4 | 1.17 |
| Example 5 | 5 | 60.0 | 53.6 | 6.4 | 20.5 | 1.00 | 6.4 | 1.15 |
| Example 6 | 6 | 60.0 | 56.7 | 3.3 | 27.3 | 1.00 | 6.5 | 1.23 |
| Example 7 | 7 | 59.5 | 54.3 | 5.2 | 24.7 | 1.00 | 6.4 | 1.18 |
| Example 8 | 8 | 61.6 | 54.8 | 6.8 | 23.1 | 1.00 | 6.4 | 1.23 |
| Example 9 | 9 | 50.2 | 45.0 | 5.2 | 12.0 | 0.80 | 6.4 | 1.15 |
| Example 10 | 10 | 65.2 | 63.1 | 2.1 | 33.7 | 1.30 | 7.0 | 1.24 |
| Example 11 | 11 | 67.8 | 60.8 | 7.0 | 40.1 | 1.40 | 7.8 | 1.24 |
| Example 12 | 12 | 59.3 | 52.5 | 6.8 | 25.8 | 1.00 | 7.5 | 1.28 |
| Example 13 | 13 | 59.3 | 55.5 | 3.8 | 25.6 | 1.70 | 6.4 | 1.17 |
| Example 14 | 14 | 59.3 | 55.5 | 3.8 | 25.0 | 1.50 | 6.4 | 1.17 |
| Example 15 | 15 | 60.2 | 58.3 | 1.9 | 26.0 | 1.00 | 5.9 | 1.24 |
| Example 16 | 16 | 56.0 | 50.3 | 5.7 | 22.1 | 1.00 | 6.9 | 1.22 |
| Example 17 | 17 | 59.3 | 55.5 | 3.8 | 25.5 | 1.40 | 6.9 | 1.24 |
| Comparative Example 1 | 18 | 60.3 | 50.4 | 9.9 | 20.9 | 1.00 | 6.4 | 1.17 |
| Comparative Example 2 | 19 | 52.0 | 40.0 | 12.0 | 10.2 | 0.90 | 6.4 | 1.15 |
| Comparative Example 3 | 20 | 51.0 | 38.2 | 12.8 | 18.6 | 1.00 | 6.4 | 1.19 |
| Comparative Example 4 | 21 | 51.0 | 37.5 | 13.5 | 18.0 | 0.90 | 6.4 | 1.19 |
| Comparative Example 5 | 22 | 58.0 | 53.0 | 5.0 | 28.0 | 1.00 | 6.4 | 1.17 |
| Comparative Example 6 | 23 | 70.0 | 68.6 | 1.4 | 30.1 | 0.60 | 6.4 | 1.18 |
| Comparative Example 7 | 24 | 68.9 | 68.4 | 0.5 | 28.7 | 0.50 | 6.4 | 1.18 |
| Comparative Example 8 | 25 | 69.3 | 68.5 | 0.8 | 24.0 | 0.50 | 6.4 | 1.18 |
| Comparative Example 9 | 26 | 60.3 | 50.4 | 9.9 | 25.5 | 1.40 | 6.6 | 1.24 |

Examples 1 to 17 and Comparative Examples 1 to 9

Performance evaluation was carried out on the obtained toners 1 to 26 according to the following method. The results are shown in Table 5.

[Low-Temperature Fixability]

The low-temperature fixability is evaluated by evaluating the lowest fixing temperature at which image defects visible on the fixed image do not occur.

Note that the visible image defects generated during low-temperature fixing are mainly cold offset generated by the toner that does not melt.

The evaluation was carried out in the following manner.

A color laser printer (HP Color Laser Jet 3525dn, manufactured by HP Corporation) from which the fixing unit was removed was prepared, the toner was taken out from the cyan cartridge, and the toner to be evaluated was filled instead thereof.

Next, an unfixed toner image (toner laid-on level: 0.9 $mg/cm^2$) of 2.0 cm in length and 15.0 cm in width was formed by using the filled toner on an image receiving paper (office planner, manufactured by Canon Inc.; 64 $g/m^2$) in a portion of 1.0 cm from the upper end portion in the sheet passing direction.

Next, the removed fixing unit was modified so that the fixing temperature and the process speed could be adjusted, and the fixing test of the unfixed image was carried out using the modified fixing unit.

First, under the normal temperature and normal humidity environment (23° C., 60% RH), the process speed was set to 300 mm/s, the initial temperature was set to 150° C., the set temperature was sequentially increased by 5° C. at a time, and the unfixed images were fixed at each temperature. With respect to the obtained fixed images, the low-temperature fixability was evaluated according to the following criteria by taking the fixing temperature at which cold offset did not occur as the lowest fixing temperature.

A: the lowest fixing temperature is not more than 155° C.
B: the lowest fixing temperature is 160° C.
C: the lowest fixing temperature is 165° C.
D: the lowest fixing temperature is 170° C.
E: the lowest fixing temperature is at least 175° C.

[Hot Offset Resistance]

In the low-temperature fixing test, hot offset resistance was evaluated according to the following criteria. A value obtained by subtracting the lowest fixing temperature from the highest temperature at which hot offset did not occur (hereinafter also referred to as W) was used and the determination was made according to the following evaluation criteria.

A: W is at least 55° C.
B: W is 45° C. or 50° C.
C: W is 35° C. or 40° C.
D: W is 25° C. or 30° C.
E: W is not more than 20° C.

[Image Quality (Evaluation of Mechanical Strength of Toner)]

The evaluation was performed by modifying a commercially available color laser printer (HP Color Laser Jet 3525dn, manufactured by HP Corporation) to operate even when only one color process cartridge is mounted. The toner contained in the cyan cartridge installed in this color laser printer was removed, the interior of the cartridge was cleaned by air blowing, and the toner (200 g) to be evaluated was filled instead thereof.

A chart with a print percentage of 1% was continuously printed out on 1000 sheets by using the OFFICE PLANNER (64 g/m$^2$) manufactured by Canon Inc. as an image receiving paper under normal temperature and normal humidity environment (23° C., 60% RH).

After the printing, one image having a white background portion was outputted by using the OFFICE PLANNER (64 g/m$^2$) manufactured by Canon Inc. as an image receiving paper. Thereafter, a fogging density (%) (=Dr (%)−Ds (%)) was calculated from the difference between the whiteness degree (reflectance Ds (%)) of the white background portion of the image having the white background portion and the whiteness degree (average reflectance Dr (%)) of the image receiving paper with respect to the image having the white background portion. The whiteness degree was measured with "REFLECTMETER MODEL TC-6 DS" (manufactured by Tokyo Denshoku Co., Ltd.). An amber light filter was used as a filter.

The higher the fogging density, the lower the mechanical strength of the toner, which means that deterioration of the toner such as exposure of wax advanced due to output of 1000 printed sheets.

The fogging density was evaluated according to the following criteria.

A: fogging density is less than 0.3%
B: fogging density is at least 0.3% and less than 0.8%
C: fogging density is at least 0.8% and less than 1.3%
D: fogging density is at least 1.3% and less than 2.0%
E: fogging density is at least 2.0%

[Temporal Stability of Image Quality]

A color laser printer modified in the same manner as in the image quality evaluation and a cartridge filled with the toner to be evaluated were prepared.

A chart with a print percentage of 1% was continuously printed out on 50 sheets by using the OFFICE PLANNER (64 g/m$^2$) manufactured by Canon Inc. as an image receiving paper under normal temperature and normal humidity environment (23° C., 60% RH).

Figure 3:
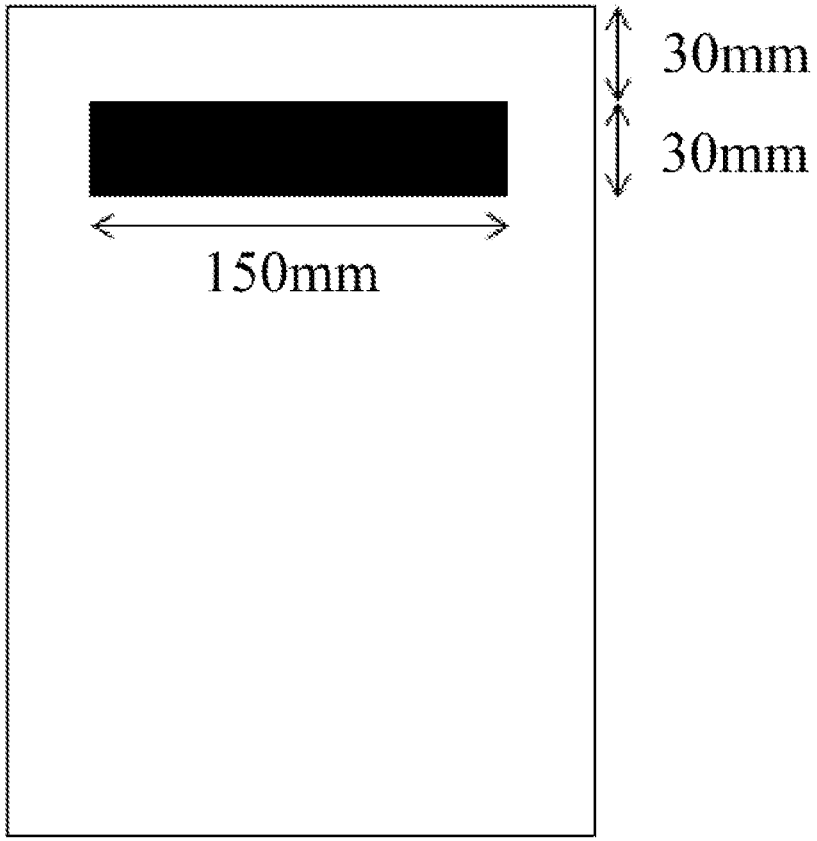
FIG. 3 is a schematic diagram showing an image pattern used for evaluating image quality.

After the printing, 10 sheets with a band image of 150 mm in width and 30 mm in length after 30 mm of blank space in the upper portion of a transfer material, such as shown in FIG. 3, were outputted by using the OFFICE PLANNER (64 g/m$^2$) manufactured by Canon Inc. as an image receiving paper.

The image density of the band images was measured. For measurement of image density, "MACBETH REFLECTION DENSITOMETER RD918" (manufactured by Macbeth Co.) was used. The relative density with respect to the output image of the white background portion having a density of 0.00 was measured, the measurement was performed for three points in the left portion, the center portion and the right portion of the band image for each of the output images, and the image density was evaluated by the average value for 10 output images.

Thereafter, the cartridge filled with the toner to be evaluated was allowed to stand for 20 days under a high-temperature and high-humidity environment (40° C., 95% RH). After this, humidity adjustment was further conducted for 1 day under normal temperature and normal humidity environment (23° C., 60% RH), and a chart with a print percentage of 1% was continuously printed out on 1000 sheets by using the OFFICE PLANNER (64 g/m$^2$) manufactured by Canon Inc. as an image receiving paper under normal temperature and normal humidity environment (23° C., 60% RH).

Thereafter, the image density was measured in the same manner as in the measurement of image density described hereinabove.

A toner having a large difference in image density before and after being allowed to stand in a high-temperature and high-humidity environment means that the deterioration over time such as the exposure of wax occurs on the surface of the toner and the temporal stability of image quality is poor. The temporal stability of image quality was evaluated according to the following criteria.

A: image density decrease rate is less than 2%
B: image density decrease rate is at least 2% and less than 5%
C: image density decrease rate is at least 5% and less than 10%
D: image density decrease rate is at least 10% and less than 20%
E: image density decrease rate is at least 20%

[Production Stability]

The ratio (D4/D1) of the weight average particle diameter (D4) to the number average particle diameter D1 (μm) in the particle size distribution of the suspension after the reaction step or after the solvent removal step in the toner production process was evaluated according to the following criteria.

A: D4/D1 is less than 1.20
B: D4/D1 is at least 1.20 and less than 1.25
C: D4/D1 is at least 1.25 and less than 1.30
D: D4/D1 is at least 1.30 and less than 1.35
E: D4/D1 is at least 1.35

TABLE 5

| | Toner No. | Low-temperature fixability: Lowest fixing temperature (° C.) | Rank | Hot offset resistance: W (° C.) | Rank | Mechanical strength: Fogging density (%) | Rank | Temporal Stability: Decrease rate (%) | Rank | Production stability: D4/D1 | Rank |
|---|---|---|---|---|---|---|---|---|---|---|---|
| Example 1 | 1 | 155 | A | 60 | A | 0.1 | A | 1 | A | 1.17 | A |
| Example 2 | 2 | 155 | A | 60 | A | 0.1 | A | 1 | A | 1.17 | A |
| Example 3 | 3 | 160 | B | 55 | A | 0.8 | C | 0 | A | 1.17 | A |
| Example 4 | 4 | 165 | C | 55 | A | 0.5 | B | 0 | A | 1.17 | A |
| Example 5 | 5 | 155 | A | 45 | B | 0.2 | A | 4 | B | 1.15 | A |
| Example 6 | 6 | 155 | A | 60 | A | 0.1 | A | 1 | A | 1.23 | B |
| Example 7 | 7 | 155 | A | 40 | C | 0.2 | A | 3 | B | 1.18 | A |
| Example 8 | 8 | 155 | A | 45 | B | 0.1 | A | 6 | C | 1.23 | B |
| Example 9 | 9 | 160 | B | 60 | A | 0.1 | A | 2 | B | 1.15 | A |
| Example 10 | 10 | 155 | A | 60 | A | 0.7 | B | 1 | A | 1.24 | B |
| Example 11 | 11 | 155 | A | 40 | C | 1.2 | C | 9 | C | 1.24 | B |
| Example 12 | 12 | 155 | A | 55 | A | 0.7 | B | 8 | C | 1.28 | C |
| Example 13 | 13 | 155 | A | 35 | C | 0.8 | C | 1 | A | 1.17 | A |
| Example 14 | 14 | 155 | A | 45 | B | 0.4 | B | 1 | A | 1.17 | A |
| Example 15 | 15 | 160 | B | 55 | A | 0.7 | B | 0 | A | 1.24 | B |
| Example 16 | 16 | 155 | A | 55 | A | 0.7 | B | 4 | B | 1.22 | B |
| Example 17 | 17 | 155 | A | 45 | B | 0.4 | B | 1 | A | 1.24 | B |
| Comparative Example 1 | 18 | 155 | A | 35 | C | 0.2 | A | 20 | E | 1.17 | A |
| Comparative Example 2 | 19 | 165 | C | 35 | C | 0.2 | A | 22 | E | 1.15 | A |
| Comparative Example 3 | 20 | 160 | B | 55 | A | 0.2 | A | 24 | E | 1.19 | A |
| Comparative Example 4 | 21 | 160 | B | 55 | A | 0.2 | A | 22 | E | 1.19 | A |
| Comparative Example 5 | 22 | 170 | D | 55 | A | 0.2 | A | 4 | B | 1.17 | A |
| Comparative Example 6 | 23 | 175 | E | 55 | A | 0.8 | C | 0 | A | 1.18 | A |
| Comparative Example 7 | 24 | 180 | E | 55 | A | 1.0 | C | 0 | A | 1.18 | A |
| Comparative Example 8 | 25 | 180 | E | 55 | A | 1.5 | D | 4 | B | 1.18 | A |
| Comparative Example 9 | 26 | 155 | A | 40 | C | 0.4 | B | 25 | E | 1.24 | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-214351, filed, Nov. 7, 2017, which is hereby incorporated by reference herein in its entirety.

What is claimed is:

1. A toner comprising: a toner particle including a binder resin and a wax A, wherein the binder resin includes a styrene acrylic copolymer, the amount of the styrene acrylic copolymer in the binder resin is at least 50% by mass, a melting point of the wax A is from 60.0° C. to 100.0° C., the wax A is compatible at 100° C. in an amount of at least 15.0 parts by mass with 100 parts by mass of a styrene-butyl acrylate copolymer, which is a copolymer of 75 parts by mass of a styrene monomer and 25 parts by mass of a butyl acrylate monomer, and has a weight average molecular weight of 30,000, in differential scanning calorimetry of the toner, where a peak temperature of a maximum exothermic peak derived from the wax A when cooling from 150° C. to 0° C. is performed at 1.0° C./min is denoted by Tc(1), and a peak temperature of a maximum exothermic peak derived from the wax A when cooling from 150° C. to 0° C. is performed at 20.0° C./min is denoted by Tc(20), the Tc(1) and the Tc(20) satisfy a relationship of 0.0° C.≤Tc(1)-Tc(20)≤7.0° C.

2. The toner according to claim 1, wherein the toner particle further includes a crystalline material, in differential scanning calorimetry of the crystalline material, where a peak temperature of a maximum exothermic peak when cooling from 150° C. to 0° C. is performed at 20.0° C./min is denoted by TcB (° C.), the Tc(20) and the TcB satisfy a relationship of Tc(20) ≤TcB.

3. The toner according to claim 2, wherein the crystalline material is compatible at 100° C. in an amount of from 0.0 parts by mass to 5.0 parts by mass with 100 parts by mass of the styrene-butyl acrylate copolymer.

4. The toner according to claim 2, wherein the crystalline material includes a hydrocarbon wax B.

5. The toner according to claim 1, wherein in the differential scanning calorimetry of the toner, an endothermic amount ΔH of an endothermic peak when heating from 0° C. to 150° C. at 10° C./min is from 10.0 J/g to 35.0 J/g.

6. The toner according to claim 1, wherein the toner particle further includes an amorphous polyester resin.

7. The toner according to claim 1, wherein a ratio of a loss elastic modulus G" to a storage elastic modulus G' at 100° C. of the toner is not more than 1.50.

8. The toner according to claim 1, wherein the styrene acrylic copolymer includes at least one copolymer selected from the group consisting of a styrene-alkyl acrylate copolymer and a styrene-alkyl methacrylate copolymer, and the alkyl group of the alkyl acrylate and the alkyl group of the alkyl methacrylate each have 2 to 10 carbon atoms.

9. A toner comprising: a toner particle including a binder resin, a wax A, and a crystalline material, wherein the binder resin includes a styrene acrylic copolymer, the amount of the styrene acrylic copolymer in the binder resin is at least 50% by mass, the ratio of the wax A to the total amount of the wax A and the crystalline material is at least 50% by mass, a melting point of the wax A is from 60.0° C. to 100.0° C., the wax A is an ester compound of a diol having 2 to 6 carbon atoms and an aliphatic monocarboxylic acid having 16 to 22 carbon atoms, a solubility parameter of the wax A is at least 8.81 $(cal/cm^3)^{1/2}$, in differential scanning calorimetry of the toner, where a peak temperature of a maximum exothermic peak when cooling from 150° C. to 0° C. is performed at 1.0° C./min is denoted by Tc(1), and a peak temperature of a maximum exothermic peak when cooling from 150° C. to 0° C. is performed at 20.0° C./min is denoted by Tc(20), the Tc(1) and the Tc(20) satisfy a relationship of $0.0° C. \leq Tc(1)-Tc(20) \leq 7.0° C.$

* * * * *